US009183984B2

(12) United States Patent
Shingaki et al.

(10) Patent No.: US 9,183,984 B2
(45) Date of Patent: Nov. 10, 2015

(54) GRAIN ORIENTED ELECTRICAL STEEL SHEET AND METHOD FOR MANUFACTURING THE SAME

(75) Inventors: Yukihiro Shingaki, Tokyo (JP); Noriko Makiishi, Tokyo (JP); Takeshi Imamura, Tokyo (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 13/814,561

(22) PCT Filed: Aug. 4, 2011

(86) PCT No.: PCT/JP2011/004441

§ 371 (c)(1), (2), (4) Date: Mar. 7, 2013

(87) PCT Pub. No.: WO2012/017670

PCT Pub. Date: Feb. 9, 2012

(65) Prior Publication Data

US 2013/0213525 A1 Aug. 22, 2013

(30) Foreign Application Priority Data

Aug. 6, 2010 (JP) ..... 2010-178129

(51) Int. Cl.
*H01F 41/00* (2006.01)
*H01F 1/01* (2006.01)

(Continued)

(52) U.S. Cl.
CPC *H01F 41/00* (2013.01); *C21D 8/12* (2013.01); *C21D 8/1216* (2013.01); *C21D 8/1272* (2013.01); *C21D 9/46* (2013.01);

(Continued)

(58) Field of Classification Search
CPC ..... C21D 8/1294; C21D 8/1272; C21D 2201/05; H01F 1/18; H01F 1/16; H01F 1/14775
USPC ..... 148/108
See application file for complete search history.

(56) References Cited

U.S. PATENT DOCUMENTS 4,293,350 A 10/1981 Ichiyama et al.
4,535,218 A * 8/1985 Krause et al. ..... 219/121.68

(Continued)

FOREIGN PATENT DOCUMENTS

EP 0 102 732 A2 3/1984
EP 0 438 592 A1 7/1991

(Continued)

OTHER PUBLICATIONS

Machine translation of JP2003201521A, Jul. 2003.*

(Continued)

*Primary Examiner* — Jie Yang
*Assistant Examiner* — Xiaowei Su
(74) *Attorney, Agent, or Firm* — DLA Piper LLP (US)

(57) ABSTRACT

A grain oriented electrical steel sheet has a total length of cracks in a film on a steel sheet surface, of 20 μm or less per 10000 $\mu m^2$ of the film, wherein magnetic domain refinement interval in a rolling direction of the steel sheet, provided in magnetic domain refinement through substantially linear introduction of thermal strain from one side of the steel sheet corresponding to a winding outer peripheral side of a coiled steel sheet at a stage of final annealing in a direction intersecting the rolling direction; and deflection of 3 mm or less per unit length: 500 mm in the rolling direction of the steel sheet.

6 Claims, 4 Drawing Sheets

(51) Int. Cl.

| | |
|---|---|
| ***C21D 8/12*** | (2006.01) |
| ***C22C 38/02*** | (2006.01) |
| ***C22C 38/04*** | (2006.01) |
| ***C23C 2/24*** | (2006.01) |
| ***H01F 1/16*** | (2006.01) |
| ***C23C 26/00*** | (2006.01) |
| ***C21D 9/46*** | (2006.01) |

(52) U.S. Cl.
CPC ..... *C22C 38/02* (2013.01); *C22C 38/04* (2013.01); *C23C 2/24* (2013.01); *C23C 26/00* (2013.01); *H01F 1/01* (2013.01); *H01F 1/16* (2013.01)

(56) References Cited

U.S. PATENT DOCUMENTS

| | | | | |
|---|---|---|---|---|
| 4,919,733 | A * | 4/1990 | Salsgiver et al. | 148/113 |
| 2002/0157734 | A1 * | 10/2002 | Senda et al. | 148/111 |

FOREIGN PATENT DOCUMENTS

| | | | |
|---|---|---|---|
| EP | 0 897 016 | A1 | 2/1999 |
| GB | 2 128 639 | A | 5/1984 |
| JP | 57-002252 | B2 | 1/1982 |
| JP | 1-208421 | A | 8/1989 |
| JP | 4-362139 | A | 12/1992 |
| JP | 6-072266 | B2 | 9/1994 |
| JP | 11-293340 | A | 10/1999 |
| JP | 2003201521 | A * | 7/2003 |
| JP | 2009-235472 | A | 10/2009 |
| JP | 2009-235473 | A | 10/2009 |
| JP | 4782248 | B | 9/2011 |

OTHER PUBLICATIONS

B. Weidenfeller, "Effect of laser treatment on high and low induction loss components of grain oriented iron-silicon sheets," *Journal of Magnetism and Magnetic Materials*, 322 (2010), pp. 69-72.

B. Weidenfeller, "Frequency dependence of loss-improvement of grain oriented silicon steels by laser scribing," *Journal of Magnetism and Magnetic Materials*, 133 (1994), pp. 177-179.

G. C. Rauch, et al., "Effect of beam dwell time on surface changes during laser scribing," *Journal of Applied Physics*, vol. 57, No. 1, pp. 4209-4211 (1985).

The Supplementary European Search Report issued on Nov. 14, 2013 in corresponding European Patent Application No. 11814305.6.

Mexican Official Action dated Jan. 29, 2014 along with an English translation from corresponding Mexican Patent Application No. MX/a/2013/001392.

Supplementary European Search Report dated Mar. 25, 2015 of corresponding European Application No. 11 814 305.6.

A. Ken, et al., "Recent Development of Electrical Steel Sheets," *The Iron and Steel Institute of Japan*, Jan. 1, 1995, pp. 1-21 along with partial English translation.

Mexican Office Action dated Aug. 7, 2014 along with an English translation from corresponding Mexican Application No. MX/9/2013/001392.

* cited by examiner

GRAIN ORIENTED ELECTRICAL STEEL SHEET AND METHOD FOR MANUFACTURING THE SAME

RELATED APPLICATIONS

This is a §371 of International Application No. PCT/JP2011/004441, with an international filing date of Aug. 4, 2011 (WO 2012/017670 published Feb. 9, 2012), which is based on Japanese Patent Application No. 2010-178129 filed Aug. 6, 2010, the subject matter of which is incorporated by reference.

TECHNICAL FIELD

This disclosure relates to a grain oriented electrical steel sheet for use in an iron core material of a transformer or the like, which steel sheet generates little noise when applied to an iron core. The disclosure also relates to a method for manufacturing the grain oriented electrical steel sheet.

BACKGROUND

A grain oriented electrical steel sheet is mainly utilized as an iron core of a transformer and required to exhibit excellent magnetization characteristics, e.g. low iron loss in particular. In this regard, it is important to highly accord secondary recrystallized grains of a steel sheet with (110)[001] orientation, i.e. what is called "Goss orientation", and reduce impurities in a product steel sheet. However, there are limits on controlling crystal grain orientations and reducing impurities in view of production cost. Accordingly, there have been developed techniques for iron loss reduction, which is to apply non-uniformity (strain) to a surface of a steel sheet physically to subdivide magnetic domain width, i.e. magnetic domain refinement techniques.

For example, Japanese Patent No. 57-002252 proposes a technique of irradiating a steel sheet after final annealing with a laser to introduce high-dislocation density regions into a surface layer of the steel sheet, thereby narrowing magnetic domain widths and reducing iron loss of the steel sheet. Further, Japanese Patent No. 06-072266 proposes a technique of controlling magnetic domain widths by irradiating a steel sheet with an electron beam.

Technical Problems

It is known that magnetostrictive behavior occurring when an electrical steel sheet is magnetized generally causes noise in a transformer. An electrical steel sheet containing Si by 3% or so generally expands in the magnetization direction. When such an electrical steel sheet as described above applied to an iron core is subjected to alternating current magnetization, the electrical steel sheet is alternately magnetized in the positive/negative magnetization direction with respect to neutral, whereby the iron core repeats expanding and shrinking movements and these magnetostrictive vibrations cause noise.

Further, electromagnetic vibrations occurring between (stacked) electrical steel sheets may cause noise in a transformer. Electrical steel sheets are subjected to alternating current magnetization and thus magnetized tend to "rattle" due to attractions and repulsions generated in these electrical steel sheets by magnetization, to cause noise. This phenomenon is well known and therefore measures are taken, when a transformer is manufactured by using electrical steel sheets, to prevent the electrical steel sheets from rattling by clamping the electrical steel sheets against each other. However, simply clamping electrical steel sheets against each other may not suffice to reliably prevent the steel sheets from rattling in some applications.

It could thus be helpful to provide connection with a grain oriented electrical steel sheet having realized low iron loss through magnetic domain refinement novel measures to reduce noise caused by an iron core of a transformer or the like when a plurality of the electrical steel sheets are stacked for use in the iron core.

SUMMARY

We thus provide:

(1) A grain oriented electrical steel sheet having the total length of cracks in film on a steel sheet surface, of 20 μm or less per 10000 $\mu m^2$ of the film, the steel sheet comprising:

magnetic domain refinement interval D (mm) in a rolling direction of the steel sheet, provided in magnetic domain refinement through linear like introduction of thermal strain in a direction intersecting the rolling direction; and deflection of 3 mm or less per unit length: 500 mm in the rolling direction of the steel sheet, wherein D satisfies following formula:

$$0.5/(\Delta\beta/10) \leq D \leq 1.0/(\Delta\beta/10),$$

Δβ (°) represents variation of angle β (angle formed by <001> axis closest to the rolling direction, of crystal grain, with respect to the steel sheet surface) per unit length: 10 mm in the rolling direction within a secondary recrystallized grain of the steel sheet.

(2) The grain oriented electrical steel sheet of (1) above, wherein the introduction of thermal strain is carried out by irradiation of electron beam.

(3) The grain oriented electrical steel sheet of (1) above, wherein the introduction of thermal strain is carried out by irradiation of laser.

(4) A method for manufacturing a grain oriented electrical steel sheet, comprising:

subjecting a grain oriented electrical steel sheet having the total length of cracks in film on a steel sheet surface, of 20 μm or less per 10000 $\mu m^2$ of the film, to magnetic domain refinement after final annealing such that thermal strain is introduced in a linear like manner in a direction intersecting a rolling direction of the steel sheet, with magnetic domain refinement interval D (mm) in the rolling direction, from a side of the steel sheet corresponding to the winding outer peripheral side of a coiled steel sheet at the stage of the final annealing, wherein D satisfies following formula:

$$0.5/(\Delta\beta/10) \leq D \leq 1.0/(\Delta\beta/10),$$

Δβ (°) represents variation of angle β (angle formed by <001> axis closest to the rolling direction, of crystal grain, with respect to the steel sheet surface) per unit length: 10 mm in the rolling direction within a secondary recrystallized grain of the steel sheet.

(5) The method for manufacturing a grain oriented electrical steel sheet of (4) above, wherein the thermal strain is introduced by irradiation of electron beam.

(6) The method for manufacturing a grain oriented electrical steel sheet of (4) above, wherein the thermal strain is introduced by irradiation of laser.

It is possible in a grain oriented electrical steel sheet subjected to thermal strain-imparting type magnetic domain refinement to exhibit reduced iron loss, to suppress deflection of the steel sheet by strictly specifying conditions of the magnetic domain refinement, so that gaps generated between a plurality of the steel sheets when the steel sheets are stacked are reduced. It is therefore possible to reduce noise of a transformer by applying on steel sheets to transformers.

DETAILED DESCRIPTION

Figure 1:
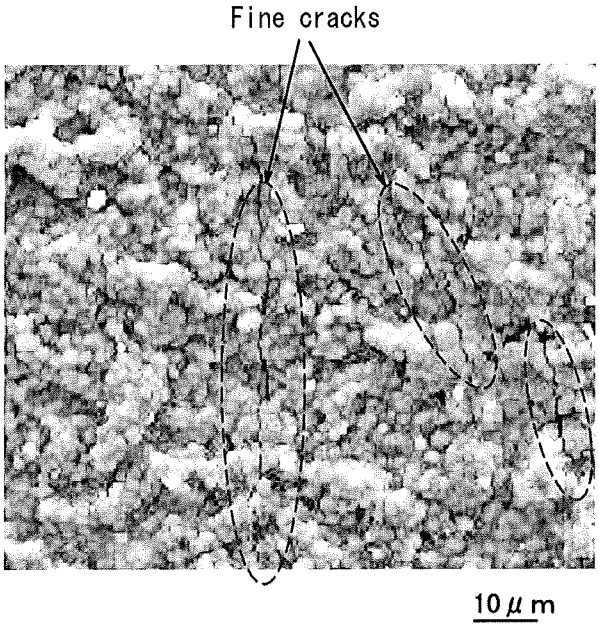
FIG. 1 is a backscattered electron image photograph showing a state where cracks have occurred in the film of a steel sheet.

A grain oriented electrical steel sheet is generally subjected to long-hour annealing in a coiled state in the manufacturing process thereof, whereby the resulting grain oriented electrical steel sheet product thus annealed tends to exhibit a tendency to naturally coil up. Accordingly, a grain oriented electrical steel sheet product is usually subjected to flattening annealing at 800° C. or higher in a continuous annealing line prior to shipping. However, a steel strip tends to experience creep deformation and thus deflection of the steel strip occurs in a furnace of a continuous annealing line at high temperature in a case where the furnace length is long and/or an interval between support rolls is large. Further, increasing in-furnace tension exerted on a steel strip during flattening annealing, which is often carried out to enhance the steel sheet correcting effect by flattening annealing, tends to cause a side-effect of facilitating creep deformation of the steel strip. Due to these factors, i.e. flattening annealing itself and increased in-furnace tension exerted on a steel strip during the flattening annealing, film on a steel sheet surface tends to suffer from crack-like damage, which is shown as "fine cracks" in FIG. 1. These cracks in the film on a surface of a steel sheet deteriorate iron loss properties of the steel sheet. FIG. 1 is a photograph of backscattered electron image (BEI) observed at acceleration voltage of 15 kV, showing fine cracks existing in forsterite film (film mainly composed of $Mg_2SiO_4$) of an electrical steel sheet product having insulation coating on the forsterite film.

Figure 2:
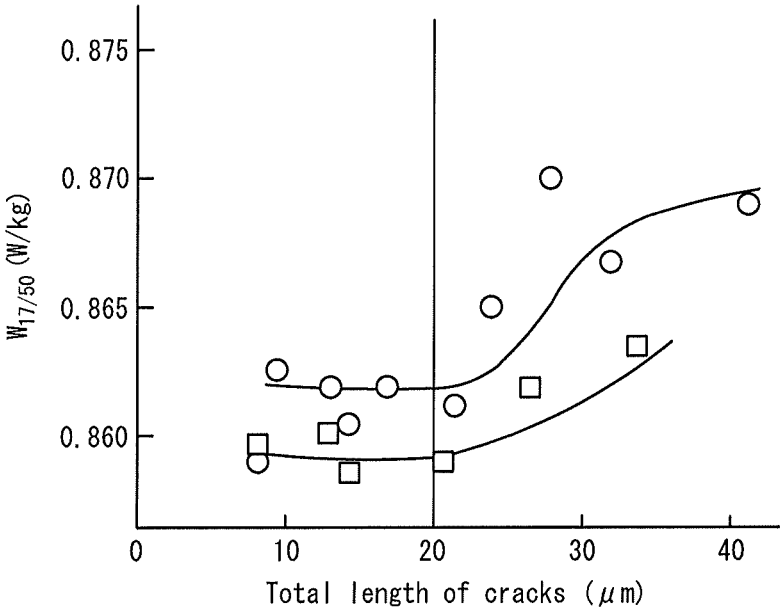
FIG. 2 is a graph showing relationships between the total length of cracks in the film and iron loss properties.

BEI of a surface observed at acceleration voltage of 15 kV, the total length of cracks per observation field: 10000 $\mu m^2$, and iron loss were analyzed respectively for each of steel sheet products each having insulating coating on forsterite film and obtained by setting in-furnace tension of a steel sheet during flattening annealing to be 5 MPa to 50 MPa. FIG. 2 shows the results of these analyses by plotting the total length of cracks in the X-axis and iron loss properties in the Y-axis. It is understood from these results that decreasing the total length of cracks to 20 μm or less is important in terms of suppressing deterioration of iron loss properties.

Damage to a film can be suppressed by decreasing the temperature during flattening annealing and/or in-furnace tension. For example, cracks are hardly generated at a steel sheet surface when flattening annealing is not carried out. However, skipping flattening annealing or lessening the steel sheet correcting effect in flattening annealing as described above allows a coiled steel sheet to partially retain a tendency to coil up, whereby a steel sheet piece cut out of the coiled steel sheet exhibits deflection. Such a tendency to coil up of steel sheet pieces results in gaps between the steel sheet pieces when the steel sheet pieces are stacked to constitute a transformer, thereby eventually causing the steel sheets to rattle from electromagnetic vibrations and thus increasing noise of the transformer. Besides, deflections existing in steel sheets are likely to render handling, i.e. lamination, of the steel sheets difficult when the steel sheets are stacked to constitute a transformer.

We discovered that strain-imparting type magnetic domain refinement can be utilized to suppress such deflection of a steel sheet as described above.

It is expected that a steel sheet surface irradiated with, e.g. an electron beam, for magnetic domain refinement exhibits due to magnetic domain structures thereof a state where some tensile stress remains in the steel sheet surface thus irradiated. Tensile stress remains in an irradiated portion of a steel sheet surface as described above presumably due to change in volume of the irradiated portion caused by heating by irradiation and subsequent rapid cooling of the portion.

Such residual tensile stress generated through magnetic domain refinement as described above not only advantageously works in terms of improving iron loss properties, but also can be positively utilized for shape correction possibly existing in a steel sheet.

Specifically, we discovered that the shape of a steel sheet can possibly be corrected by tensile stress generated through magnetic domain refinement, i.e. by subjecting the steel sheet to thermal strain-imparting type magnetic domain refinement from the side of the steel sheet corresponding to the winding outer peripheral side of a coiled steel sheet at the annealing stage (or the side of the steel sheet slightly protruding due to a residual tendency to coil up). Further, we studied adequate beam density and magnetic domain refinement interval suitable to correct deflection through magnetic domain refinement. As a result we discovered measures to correct deflection of a steel sheet, while satisfactorily decreasing iron less of the steel sheet.

Our steel sheets are essentially subjected to thermal strain-imparting type magnetic domain refinement. Regarding conditions of electron beam/laser irradiation, an irradiation direction is preferably a direction intersecting the rolling direction and more preferably a direction inclined by 60° to 90° with respect to the rolling direction and an irradiation interval is preferably around 3 mm to 15 mm in the rolling direction in terms of improving iron loss properties by the magnetic domain refinement.

Further, in the case of electron beam irradiation, it is effective to carry out spot-like or linear irradiation at acceleration voltage: 10 kV to 200 kV, electric current: 0.005 mA to 10 mA, and beam diameter (beam width): 0.005 mm to 1 mm.

In the case of using a continuous-wave laser, the power density thereof, which depends on scanning rate of laser beam, is preferably 100 $W/mm^2$ to 10000 $W/mm^2$. The Power density of a laser beam may either remain constant or be periodically changed by modulation. A semiconductor laser-excitation type fiber laser or the like is effective as an excitation source.

A Q-switch type pulse laser or the like can cause an effect similar to that caused by the continuous-wave laser. However, use of a pulse laser may locally leave magnetic domain refinement marks or cause damage to the film on a surface of a steel sheet which necessitates another coating to ensure insulation of the steel sheet. Accordingly, a continuous-wave laser is suitable in industrial terms.

Provided that the respective conditions satisfy the aforementioned preferable ranges, it is assumed regarding shape correction of a steel sheet that the radially inner side of a coiled steel sheet having a stronger tendency to coil up requires the higher tensile stress to be imparted therein by thermal strain-imparting type magnetic domain refinement, while the radially outer side of a coiled steel sheet (having a weaker tendency to coil up) requires a lower tensile stress to be imparted therein for shape correction.

We thus studied irradiation intervals of electron beams, which significantly affect the tensile stress described above. Specifically, an experiment was carried out by: cutting a test piece having dimension of 500 mm in the rolling direction×50 mm in the widthwise direction out of a steel sheet having insulating coating on forsterite film; irradiating a side of the test piece corresponding to the winding outer peripheral side of a coiled steel sheet at the stage of annealing (i.e. a side of the test piece slightly protruding due to a residual tendency to coil up) with electron beam in a direction inclined with respect to the rolling direction by 90° (i.e. "C" direction) under conditions including acceleration voltage: 200 kV, electric current: 0.8 mA, beam diameter: 0.5 mm, and beam scanning rate: 2 m/second; and determining specific irradiation interval suitable for shape correction of the test piece.

Figure 3:
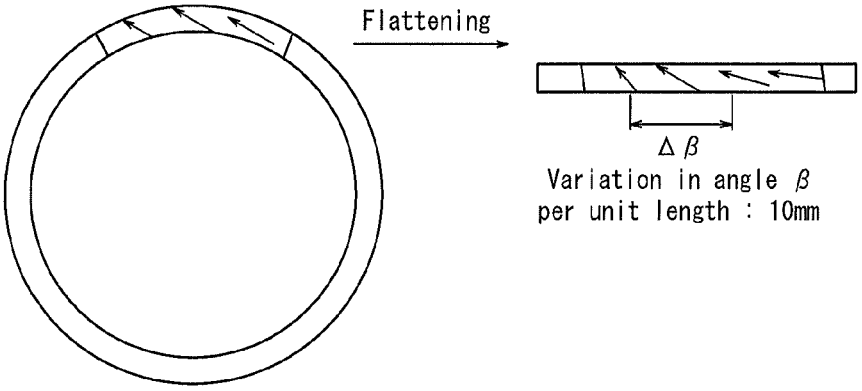
FIG. 3 is a schematic view showing orientation(s) of crystal grain(s) in a steel sheet wound out of a coil.
Figure 4:
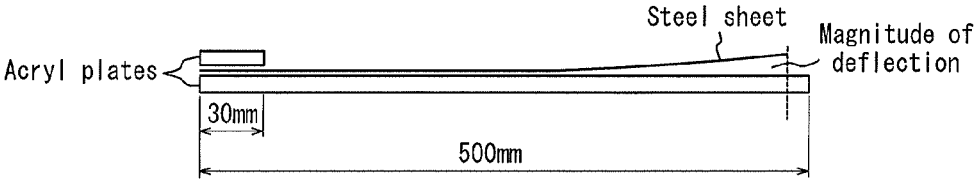
FIG. 4 is a view showing a method for evaluating magnitude of deflection of a steel sheet.

Δβ (°) was used in the aforementioned experiment as an index to indicate a position in the radial direction within the coiled steel sheet from which position a test piece was derived. Specifically, Δβ represents, provided that angle β is an angle formed by <001> axis closest to the rolling direction, of a secondary recrystallized grain, with respect to a surface of a steel sheet, a variation range of the angle β per unit length: 10 mm in the rolling direction within a secondary recrystallized grain of the steel sheet, as shown in FIG. 3 (FIG. 3 schematically shows orientation(s) of crystal grain(s) in a steel sheet wound out of a coil). Δβ correlates to a coil diameter (precisely, a given diameter within a coil) with one-to-one correspondence and, for example, in a case where the coil diameter is 1000 mm, a variation range of the angle β measured per unit length: 10 mm in the rolling direction within the same secondary recrystallized grain of the steel sheet corresponds to 1.14°.

Four types of test pieces were prepared in the aforementioned experiment so that the Δβ values thereof varied at four levels including 2.29°, 1.14°, 0.76°, and 0.57°. The shape of each test piece was evaluated by: holding an end portion (30 mm) of the test piece having length: 500 mm between acryl plates such that deflection of the test piece was measurable by setting the widthwise direction thereof in the vertical direction; and measuring magnitude of deflection (mm). The measurement results are shown in FIG. 5.

Figure 5:
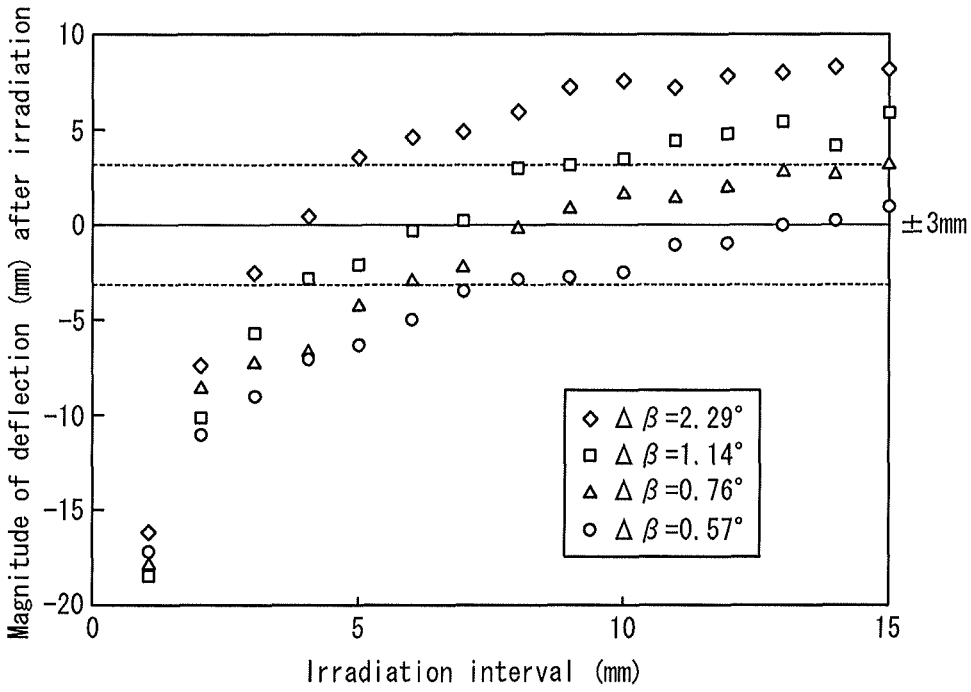
FIG. 5 is a graph showing relationships between magnetic domain refinement interval D and magnitude of deflection at various $\Delta\beta$ values.

It is understood from FIG. 5 that deflection of the steel sheet can be controllably suppressed within a range of ±3 mm by setting the irradiation interval to 3 mm to 4 mm when Δβ is 2.29°, 4 mm to 8 mm when Δβ is 1.14°, 7 mm to 13 mm when Δβ is 0.76°, and 8 mm or more when Δβ is 0.57°, respectively.

We repeated experiments as described above to determine adequate irradiation interval D (mm) in magnetic domain refinement to correct the shape of a steel sheet and found out that the magnitude of deflection of a steel sheet can be suppressed to the acceptable level, i.e. ±3 mm, by carrying out magnetic domain refinement on the steel sheet such that irradiation interval D satisfies the following formula.

$$0.5/(\Delta\beta/10) \leq D \leq 1.0/(\Delta\beta/10)$$

In a case where Δβ exceeds 3.3°, the irradiation interval presumably required for shape correction of a steel sheet is 3 mm or less, which makes it difficult to achieve both magnetic domain refinement and shape correction for the steel sheet in a compatible manner. Δβ is therefore preferably 3.3° or less. In a case where Δβ is very small, deflection hardly occurs in a steel sheet. In particular, if our methods are applied to a steel sheet having Δα<0.4°, the irradiation interval theoretically required for shape correction of a steel sheet will be D>15 mm, which makes it impossible to adequately obtain a good effect of magnetic domain refinement.

Measuring crystal orientations to determine Δβ prior to each magnetic domain refinement operation is not always necessary because Δβ correlates to a coil diameter or a given diameter within a coil with one-to-one correspondence as described above. That is, it basically suffices to estimate Δβ and determine an adequate irradiation interval D (mm) in view of a given diameter within a coiled steel sheet and then carry out magnetic domain refinement according to the irradiation interval D thus determined.

Our grain oriented electrical steel sheet subjected to magnetic domain refinement may be any of conventionally known grain oriented electrical steel sheets. Examples of conventionally known grain oriented electrical steel sheets include an electrical steel material containing Si by 2.0 mass % to 8.0 mass %.

Si: 2.0 Mass % to 8.0 Mass %

Silicon is an element which effectively increases electrical resistance of steel to improve iron loss properties thereof. Silicon content in steel equal to or higher than 2.0 mass % ensures a particularly good effect of reducing iron loss. On the other hand, Si content in steel equal to or lower than 8.0 mass % ensures particularly good formability and magnetic flux density of steel. Accordingly, Si content in steel is preferably 2.0 mass % to 8.0 mass %.

The higher degree of accumulation of crystal grains in <100> direction causes the better effect of reducing iron loss through magnetic domain refinement. Magnetic flux density $B_8$ as an index of accumulation of crystal orientations is therefore preferably at least 1.90 T.

Specific examples of basic components and other components to be optionally added of the steel material for our grain oriented electrical steel sheets are as follows.

C: 0.08 Mass % or Less

Carbon is added to improve the microstructure of a hot rolled steel sheet. Carbon content in steel is preferably 0.08 mass % or less because a carbon content exceeding 0.08 mass % increases the burden of reducing carbon content during the manufacturing process to 50 mass ppm or less at which magnetic aging is reliably prevented. The lower limit of carbon content in steel need not be particularly set because secondary recrystallization is possible in a material not containing carbon.

Mn: 0.005 Mass % to 1.0 Mass

Manganese is an element which advantageously achieves good hot-formability of steel, Manganese content in steel less than 0.005 mass % cannot sufficiently cause the good effect of Mn addition. Manganese content in steel equal to or lower than 1.0 mass % ensures particularly good magnetic flux density of a product steel sheet. Accordingly, Mn content in steel is preferably 0.005 mass % to 1.0 mass %.

When an inhibitor is to be used to facilitate secondary recrystallization, the chemical composition of the grain oriented electrical steel sheet may contain, for example, appropriate amounts of Al and N in a case where an AlN-based inhibitor is utilized or appropriate amounts of Mn and Se and/or S in a case where MnS and/or MnSe-based inhibitor is utilized. Both AlN-based inhibitor and MnS and/or MnSe-based inhibitor may be used in combination, of course. When inhibitors are used as described above, contents of Al, N, S and Se are preferably Al: 0.01 mass % to 0.065 mass %, N:

0.005 mass % to 0.012 mass %, S: 0.005 mass % to 0.03 mass %, and Se: 0.005 mass % to 0.03 mass %, respectively.

Our grain oriented electrical steel sheets need not use any inhibitor and may have restricted Al, N, S, Se contents. In this case, contents of Al, N, S and Se are preferably suppressed to Al: 100 mass ppm or less, N: 50 mass ppm or less, S: 50 mass ppm or less, and Se: 50 mass ppm or less, respectively.

Further, the steel material for our grain oriented electrical steel sheets may contain, for example, the following elements as magnetic properties improving components in addition to the basic components described above. At least one element selected from Ni: 0.03 mass % to 1.50 mass %. Sn: 0.01 mass % to 1.50 mass %, Sb: 0.005 mass % to 1.50 mass %, Cu: 0.03 mass % to 3.0 mass %, P: 0.03 mass % to 0.50 mass %, Mo: 0.005 mass % to 0.10 mass %, Nb: 0.0005 mass % to 0.0100 mass %, and Cr: 0.03 mass % to 1.50 mass %

Nickel is a useful element in terms of further improving the microstructure of a hot rolled steel sheet and thus magnetic properties of a resulting steel sheet. Nickel content in steel less than 0.03 mass % cannot cause this magnetic properties-improving effect by Ni sufficiently. Nickel content in steel equal to or lower than 1.5 mass % ensures stability in secondary recrystallization to improve magnetic properties of a resulting steel sheet. Accordingly, Ni content in steel is preferably 0.03 mass % to 1.5 mass %.

Sn, Sb, Cu, P, Mo, Nb and Cr are useful elements, respectively, in terms of further improving magnetic properties of the grain oriented electrical steel sheet. Contents of these elements lower than the respective lower limits described above result in an insufficient magnetic properties-improving effect. Contents of these elements equal to or lower than the respective upper limits described above ensure the optimum growth of secondary recrystallized grains. Accordingly, it is preferable that the steel material for the grain oriented electrical steel sheet contains at least one of Sn, Sb, Cu, P, Mo, Nb and Cr within the respective ranges thereof specified above.

The balance other than the aforementioned components of the steel material for the grain oriented electrical steel sheet is preferably Fe and incidental impurities incidentally mixed thereinto during the manufacturing process.

A steel slab having the aforementioned chemical composition is subjected to the conventional processes for manufacturing a grain oriented electrical steel sheet including annealing for secondary recrystallization and formation of a tension insulating coating thereon, to be finished as a grain oriented electrical steel sheet. Specifically, a grain oriented electrical steel sheet is manufactured by: subjecting the steel slab to heating and hot rolling to obtain a hot rolled steel sheet; subjecting the hot rolled steel sheet to either a single cold rolling operation or at least two cold rolling operations with intermediate annealing therebetween to obtain a cold rolled steel sheet having the final sheet thickness; and subjecting the cold rolled steel sheet to decarburization, annealing for primary recrystallization, coating of annealing separator mainly composed of MgO, the final annealing including secondary recrystallization process and purification process, provision of tension insulating coating composed of, e.g. colloidal silica and magnesium phosphate, and baking in this order.

"Annealing separator mainly composed of MgO" means that the annealing separator may contain known annealing separator components and/or physical property-improving components other than magnesia unless presence thereof inhibits formation of forsterite film relevant to the main object of the present invention.

Thermal strain-imparting type magnetic domain refinement is carried out for shape correction of the steel sheet from the side of the steel sheet corresponding to the winding outer peripheral side of a coiled steel sheet at the stage of the final annealing (i.e. the side slightly protruding due to a tendency to coil up of the steel sheet) after either final annealing or formation of the tension insulating coating.

EXAMPLES

A grain oriented electrical steel sheet having forsterite film thereon was obtained by subjecting a cold rolled steel sheet containing Si by 3 mass % and having the final sheet thickness of 0.27 mm to decarburization, annealing for primary recrystallization, coating of an annealing separator mainly composed of MgO, coiling, and the final annealing including secondary recrystallization process and purification process in this order. Test specimens each having dimension of 500 mm in the rolling direction×100 mm in the widthwise direction were cut out of a coiled steel sheet at respective positions in the radial direction within the coiled steel sheet. Each of the test specimens thus cut out was coated with insulating coating composed of 60% colloidal silica and aluminum phosphate and baked at 800° C. Each test specimen was imparted, in this connection, with tension 5 MPa to 50 MPa in the rolling direction for flattening it simultaneously with the baking at 800° C., so that a steel sheet as the test specimen suffered from creep deformation and film thereof was damaged. Damage to the film was evaluated by observing a backscattered electron image obtained at acceleration voltage of 15 kV, of the film, and determining the total length of cracks per 10000 $\mu m^2$ of the film.

Next, the steel sheet as the test specimen was subjected to magnetic domain refinement including irradiating a side of the steel sheet corresponding to the winding outer peripheral side of the coiled steel sheet at the stage of the final annealing (secondary recystallization) with an electron beam or continuous-wave fiber laser in a direction orthogonal to the rolling direction and then magnitude of deflection of the steel sheet was measured.

Further, each test specimen was sheared into trapezoidal steel sheets with bevel edges, each having shorter side: 300 mm, longer side: 500 mm, and width (height): 100 mm. The trapezoidal steel sheets were stacked to constitute a single-phase transformer having the total weight of 100 kg. The single-phase transformer was clamped such that clamping force exerted thereon was 0.098 MPa as a whole in order to suppress rattling of the steel sheets. Noise was measured by using a condenser microphone under the conditions of magnetic flux density: 1.7 T and excitation frequency: 50 Hz. Auditory sensation weighting was carried out by converting the noise into A-weighted sound level.

The results of the aforementioned evaluation and measurements are shown in Table 1. It is understood from these results that our test specimens unanimously reduced magnitude of deflection thereof and achieved both low iron loss and low noise in a compatible manner in the resulting transformers.

Further, it has been confirmed that in-furnace tension during flattening annealing is preferably suppressed to 10 MPa or less to reduce the total length of cracks in forsterite film to 20 μm or less per 10000 $\mu m^2$ of the film. On the other hand, irradiation interval out of our range (e.g. test specimens E, H and I) results in magnitude of deflection exceeding 3 mm per unit length: 500 mm and thus loud noise. In the cases where the total length of cracks in forsterite film exceeds 20 μm due to too much flattening, magnitude of deflection prior to introduction of thermal strain is much smaller than that expected in our steel sheets, whereby the magnitude of deflection may eventually exceed 3 mm and noise increases although irradiation intervals are within our range (e.g. test specimens C, D, J and the like) or, if magnitude of eventual deflection is not so large, iron loss fails to be reduced sufficiently due to damage caused to forsterite film (e.g. test specimen N).

TABLE 1

| | Steel sheet material | | | | | Magnetic domain refinement | | Physical properties exhibited after magnetic domain refinement | | | |
|---|---|---|---|---|---|---|---|---|---|---|---|
| | | | | | | | | | Single-phase transformer | | |
| Specimen ID | Δβ(°) | 0.5/(Δβ/10) | 1.0/(Δβ/10) | Total length of cracks (μm/10000 $\mu m^2$) | In-furnace tension (MPa) in flattening annealing | Technique | Irradiation interval (mm) | Single steel sheet Magnitude of deflection (mm) | W17/50 (W/kg) | Noise (dBA) | Note |
| A | 1.64 | 3.05 | 6.10 | 15 | 8 | Electron beam | 3.5 | −2.4 | 0.92 | 42 | Example |
| B | | | | 18 | 10 | Electron beam | 5.5 | +1.8 | 0.89 | 43 | Example |
| C | | | | 25 | 20 | Electron beam | 3.5 | −6.0 | 0.96 | 51 | Comp. Example |
| D | | | | 30 | 30 | Electron beam | 5.5 | −4.8 | 0.94 | 48 | Comp. Example |
| E | | | | 17 | 17 | Electron beam | 7.0 | +3.7 | 0.91 | 48 | Comp. Example |
| F | 0.82 | 6.10 | 12.20 | 18 | 10 | Laser | 10.5 | +0.1 | 0.93 | 40 | Example |
| G | | | | 15 | 5 | Electron beam | 7.0 | −2.0 | 0.89 | 43 | Example |
| H | | | | 15 | 5 | Electron beam | 5.5 | −4.4 | 0.88 | 47 | Comp. Example |
| I | | | | 28 | 30 | Electron beam | 5.5 | −7.5 | 0.91 | 53 | Comp. Example |
| J | | | | 100 | 50 | Electron beam | 7.0 | −5.0 | 0.93 | 50 | Comp. Example |
| K | 0.55 | 9.09 | 18.18 | 16 | 8 | Laser | 9.5 | −2.5 | 0.92 | 43 | Example |
| L | | | | 19 | 10 | Electron beam | 9.5 | −2.6 | 0.91 | 44 | Example |
| M | | | | 18 | 10 | Electron beam | 18.0 | +0.2 | 0.96 | 42 | Example |
| N | | | | 60 | 40 | Electron beam | 15.0 | +0.3 | 0.99 | 43 | Comp. Example |
| O | | | | 25 | 30 | Laser | 5.0 | −7.9 | 0.90 | 54 | Comp. Example |

"Example" represents Examples according to the present invention.

What is claimed is:

1. A grain oriented electrical steel sheet having a total length of cracks in a film on a steel sheet surface, of 20 μm or less per 10000 $\mu m^2$ of the film, wherein:

magnetic domain refinement interval D (mm) in a rolling direction of the steel sheet, provided in magnetic domain refinement through substantially linear introduction of thermal strain from one side of the steel sheet corresponding to a winding outer peripheral side of a coiled steel sheet at a stage of final annealing in a direction intersecting the rolling direction; and deflection of 3mm or less per unit length: 500 mm in the rolling direction of the steel sheet, wherein D satisfies:

$$0.5/(\Delta\beta/10) \leq D \leq 1.0/(\Delta\beta/10),$$

Δβ (°) represents variation of angle β (angle formed by <001> axis closest to the rolling direction, of crystal grain, with respect to the steel sheet surface) per unit length: 10 mm in the rolling direction within a secondary recrystallized grain of the steel sheet, and Δβis 0.4° to 3.3°.

2. The grain oriented electrical steel sheet of claim 1, wherein the introduction of thermal strain is carried out by irradiation with an electron beam.

3. The grain oriented electrical steel sheet of claim 1, wherein the introduction of thermal strain is carried out by irradiation with a laser.

4. A method of manufacturing a grain oriented electrical steel sheet comprising:

subjecting a grain oriented electrical steel sheet having a total length of cracks in film on a steel sheet surface, of 20 μm or less per 10000 $\mu m^2$ of the film, to magnetic domain refinement after final annealing such that thermal strain is introduced in a substantially linear manner in a direction intersecting a rolling direction of the steel sheet, with a magnetic domain refinement interval D (mm) in the rolling direction, from a side of the steel sheet corresponding to a winding outer peripheral side of a coiled steel sheet at a stage of final annealing, thereby the deflection being 3 mm or less per unit length: 500 mm in the rolling direction of the steel sheet, wherein D satisfies:

$$0.5/(\Delta\beta/10) \leq D \leq 1.0/(\Delta\beta/10),$$

Δβ/10(°) represents variation of angle β (angle formed by <001> axis closest to the rolling direction, of crystal grain, with respect to the steel sheet surface) per unit length: 10 mm in the rolling direction within a secondary recrystallized grain of the steel sheet, and Δβ is 0.4° to 3.3°.

5. The method of claim 4, wherein the thermal strain is introduced by irradiation with an electron beam.

6. The method of claim 4, wherein the thermal strain is introduced by irradiation with a laser.

* * * * *